US008608324B1

(12) United States Patent
Bains

(10) Patent No.: US 8,608,324 B1
(45) Date of Patent: Dec. 17, 2013

(54) PORTABLE ANTI-CONDENSATION MIRROR

(71) Applicant: Hartaj Bains, Nairobi (KE)

(72) Inventor: Hartaj Bains, Nairobi (KE)

( * ) Notice: Subject to any disclaimer, the term of this patent is extended or adjusted under 35 U.S.C. 154(b) by 0 days.

(21) Appl. No.: 13/666,015

(22) Filed: Nov. 1, 2012

(51) Int. Cl.
*G02B 5/124* (2006.01)
*B60R 1/06* (2006.01)
*G02B 7/182* (2006.01)

(52) U.S. Cl.
USPC ..... 359/514; 359/508; 359/881

(58) Field of Classification Search
USPC ..... 359/514
See application file for complete search history.

(56) References Cited

U.S. PATENT DOCUMENTS

| | | | |
|---|---|---|---|
| 3,594,063 | A | 7/1971 | Smillie, III |
| 4,701,594 | A | 10/1987 | Powell |
| 4,832,475 | A | 5/1989 | Daniels |
| 6,619,805 | B1 | 9/2003 | Roth |
| 7,249,858 | B2 | 7/2007 | Blackwood |

*Primary Examiner* — Jade R Chwasz
(74) *Attorney, Agent, or Firm* — Dale J. Ream

(57) ABSTRACT

A portable anti-condensation mirror apparatus for use while shaving in a shower environment includes a housing having a plurality of walls that together define an interior area. A front wall of the housing defines a slot. The apparatus includes a reflection panel having a first end operatively coupled to the housing and an opposed free end, the reflection panel being movable between a retracted configuration substantially inside the interior area and an extended configuration extending through the slot and substantially outside the interior area. At least one housing suction cup is mounted to a rear wall of the housing so as to selectively mount the housing in a shower. A heating member is positioned in the interior area and configured to generate heat inside the interior area when energized by a battery.

13 Claims, 8 Drawing Sheets

PORTABLE ANTI-CONDENSATION MIRROR

BACKGROUND OF THE INVENTION

This invention relates generally to condensation free shower mirrors and, more particularly, to a portable anti-condensation minor apparatus. More particularly, the present invention includes a device that is portable for travel that heats a minor surface independent of the shower, heated water, or other plumbing fixtures.

Many men prefer to shave while still in the shower—sometimes out of preference for the warmth of the shower environment by comparison to being cold after stepping out of the shower into a colder bathroom environment. In either case, the shower or a steamed up bathroom is problematic for shaving because the mirror may become fogged up. Specifically, condensation forms on a minor that is not as warm as the steam of hot shower water, making it virtually impossible to clearly see a reflection while shaving.

Various devices have been proposed in the art for heating up a reflective surface mounted in the shower. Specifically, some attempts to solve the problem outlined above use the heated shower stream itself to heat a mirror, structures in the mirror to store an amount of hot water to heat the mirror, and the use of special heat retention surfaces. Although assumably effective for their intended purposes, the existing devices and proposals do not provide an anti-condensation apparatus that is both portable and that prevents condensation without relation to a shower stream itself or needed special minor surface construction.

Therefore, it would be desirable to have a portable anti-condensation mirror apparatus that overcomes the limitations of the prior art.

SUMMARY OF THE INVENTION

A portable anti-condensation mirror apparatus for use while shaving in a shower environment according to the present invention includes a housing having a plurality of walls that together define an interior area. A front wall of the housing defines a slot. The apparatus includes a reflection panel having a first end operatively coupled to the housing and an opposed free end, the reflection panel being movable between a retracted configuration substantially inside the interior area and an extended configuration extending through the slot and substantially outside the interior area. At least one housing suction cup is mounted to a rear wall of the housing so as to selectively mount the housing in a shower. A heating member is positioned in the interior area and configured to generate heat inside the interior area when energized by a battery.

Therefore, a general object of this invention is to provide a portable anti-condensation minor apparatus that provides a reflective surface for use while shaving in the shower.

Another object of this invention is to provide a portable anti-condensation minor apparatus, as aforesaid, that may be positioned in a retracted configuration so as to be portable for travel or storage.

Yet another object of this invention is to provide a portable anti-condensation minor apparatus, as aforesaid, that heats the reflective surface prior to use so that the reflective surface does not fog up.

A further object of this invention is to provide a portable anti-condensation minor apparatus, as aforesaid, that includes a gel pack that is heated when energized by a battery.

A still further object of this invention is to provide a portable anti-condensation mirror apparatus, as aforesaid, in which the reflective panel is movable between a retracted configuration inside a housing and an extended configuration extending outside the housing.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
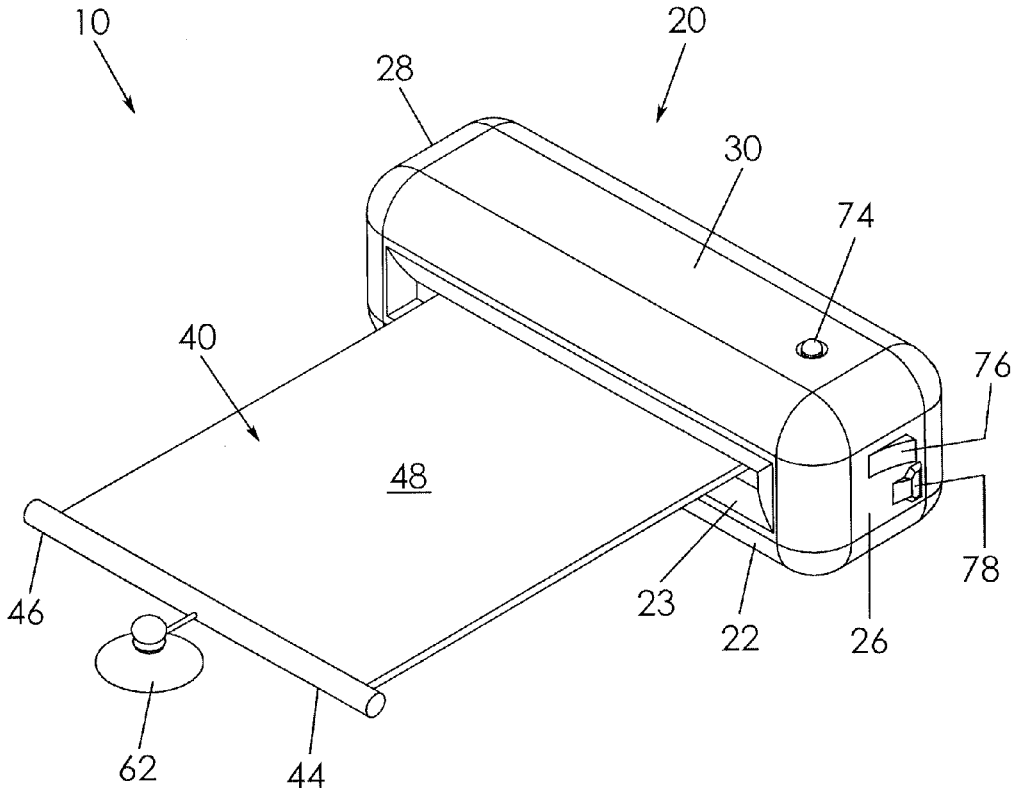
FIG. 1 is a front perspective view of a portable anti-condensation mirror apparatus according to a preferred embodiment with a reflective panel in an extended configuration.
Figure 2:
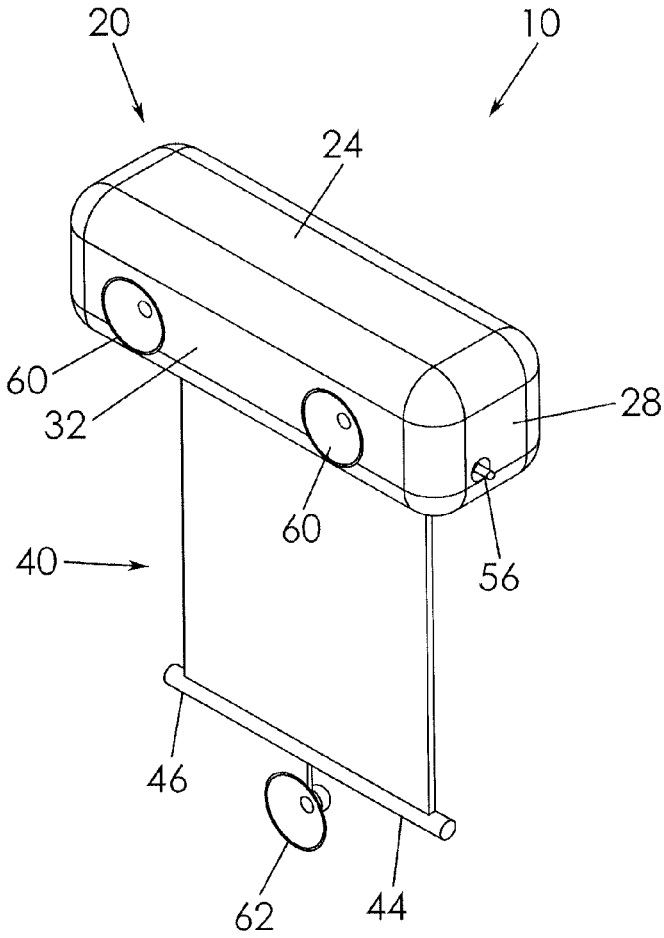
FIG. 2 is a rear perspective view of the apparatus as in FIG. 1.
Figure 3A:
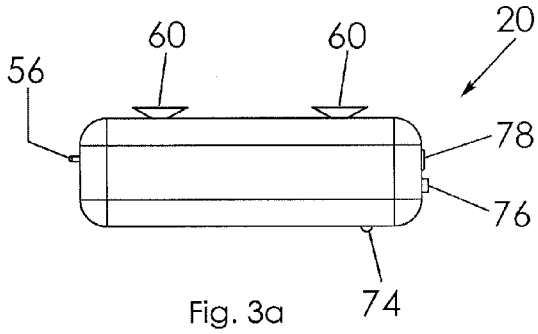
FIG. 3*a* is a bottom view of the apparatus as in FIG. 1.
Figure 3B:
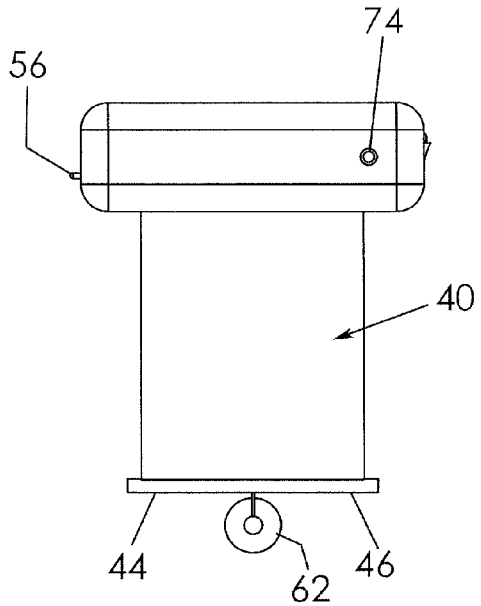
FIG. 3*b* is a top view of the apparatus as in FIG. 1.
Figure 3C:
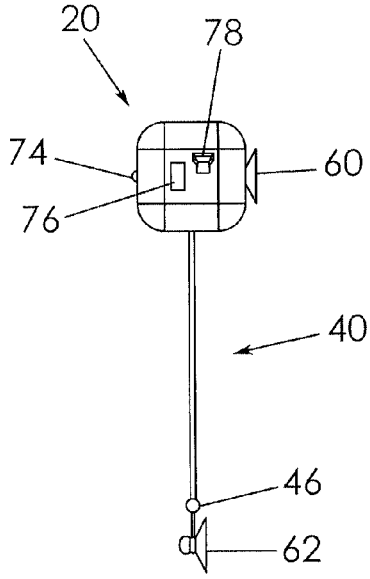
FIG. 3*c* is a side view of the apparatus as in FIG. 1.
Figure 4A:
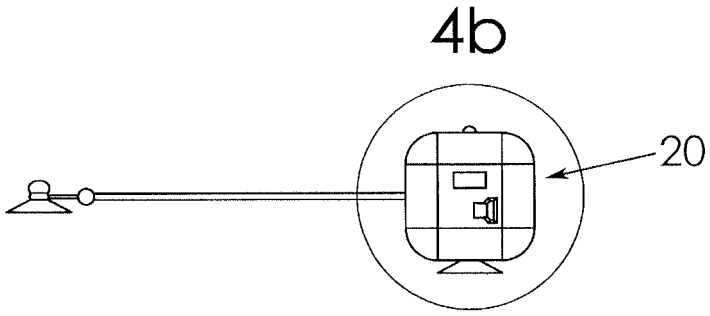
FIG. 4*a* is a side view from another angle of the apparatus as in FIG. 3*c;*
Figure 4B:
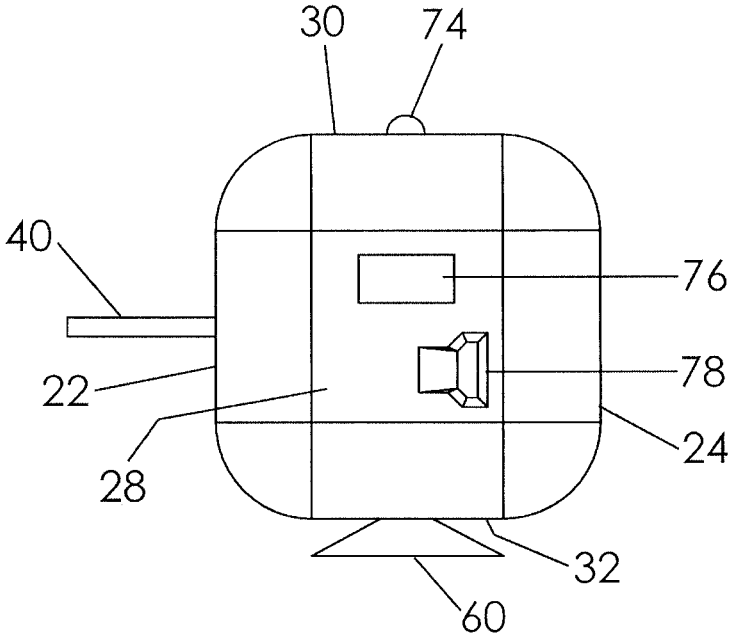
FIG. 4*b* is an isolated view on an enlarged scale taken from a portion of FIG. 4*a;*
Figure 5A:
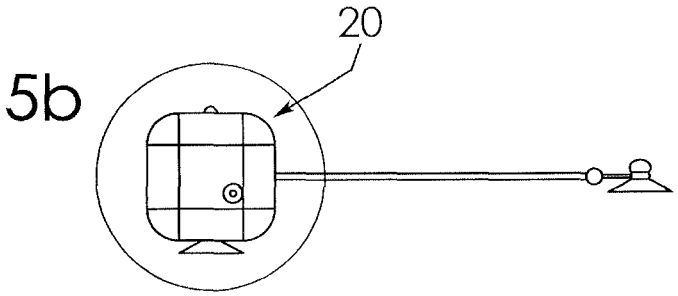
FIG. 5*a* is another side view of the apparatus as in FIG. 1.
Figure 5B:
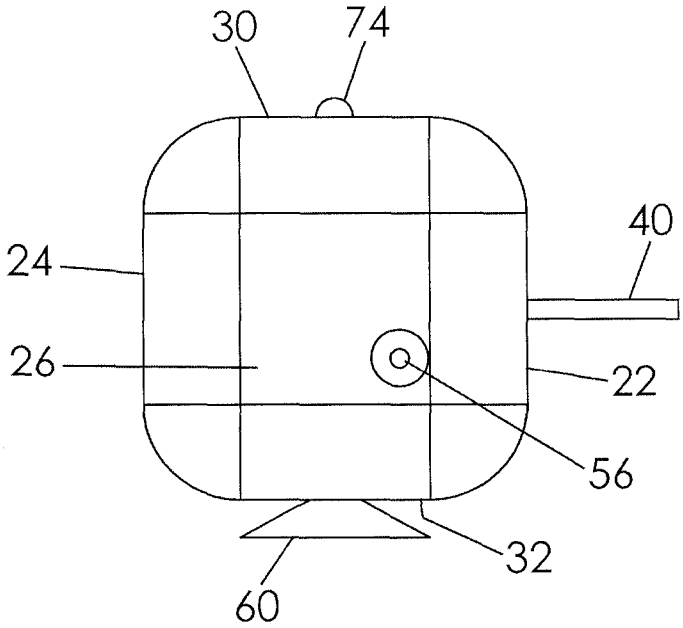
FIG. 5*b* is an isolated view on an enlarged scale taken from a portion of FIG. 5*a;*

A portable anti-condensation minor apparatus according to a preferred embodiment of the present invention will now be described with reference to FIGS. 1 to 8 of the accompanying drawings. The minor apparatus 10 includes a housing 20, a reflective panel 40, a plurality of suction cups 60, 62 and a heating member 70.

The housing 20 includes a plurality of walls that, together, define an interior area. In one embodiment, the housing 20 may include front 22 and back 24 walls, opposed side walls 26, 28, as well as top 30 and bottom 32 walls. The front wall 22 defines an elongate slot 23 extending substantially between the side walls 26, 28. The slot 23 is in communication with the interior area.

Figure 8:
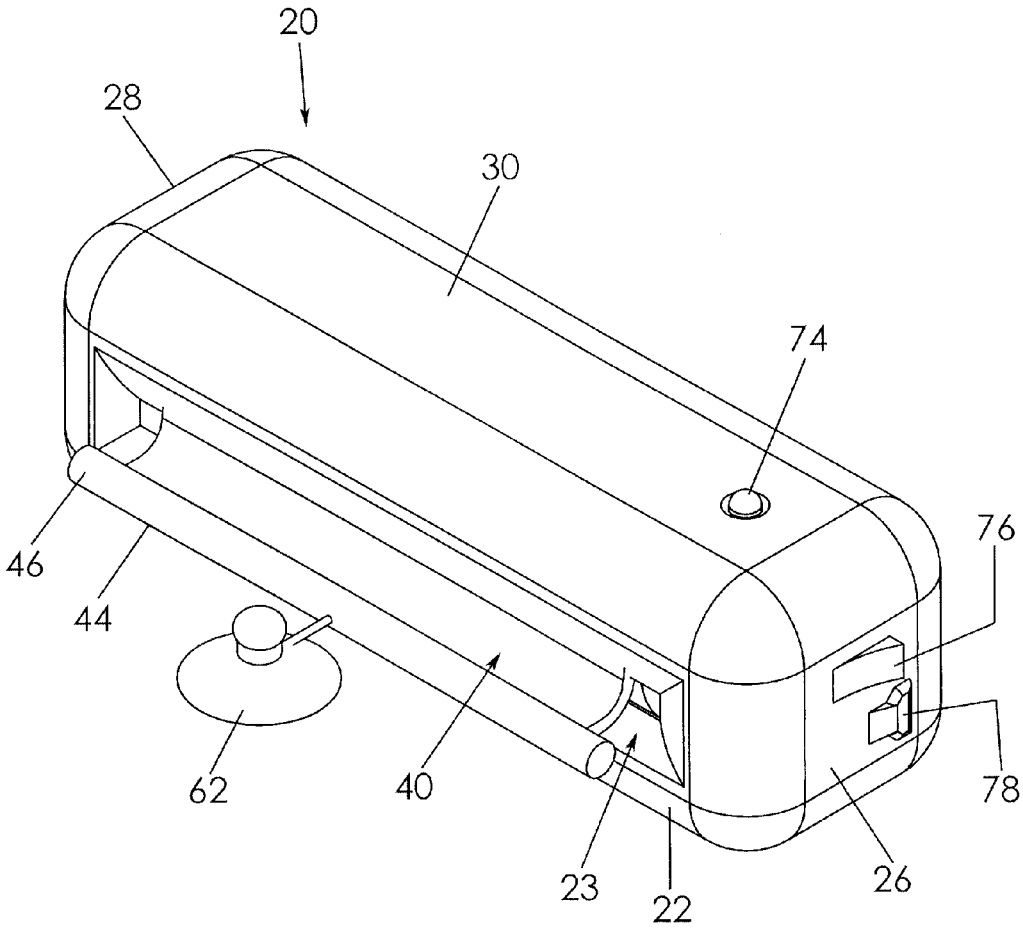
FIG. 8 is a perspective view of the apparatus as in FIG. 1 with the reflective panel in a retracted configuration.

The reflective panel 40 is a planar sheet of material having a first end 42 operatively coupled to the housing 20 within the interior area and an opposed free end 44. The reflective panel 40 includes a generally flexible construction and is movable between a retracted construction substantially inside the interior area of the housing 20 and an extended configuration substantially outside the interior area. At the extended configuration, the reflective panel 40 extends through the slot 23 (FIG. 1). The reflective panel 40 may include a handle 46 attached to the free end 44 thereof, the handle 46 being configured to enhance a user's ability to grasp the reflective panel 40 and move it from the retracted configuration to the extended configuration. In addition, the handle 46 may include a diameter that is larger than the slot 23 so as to prevent the reflective panel 40 from completely entering the interior area of the housing 20 at the retracted configuration (FIG. 8). Further, the reflective panel 40 may include a front surface 48 constructed of a reflective material.

Figure 6A:
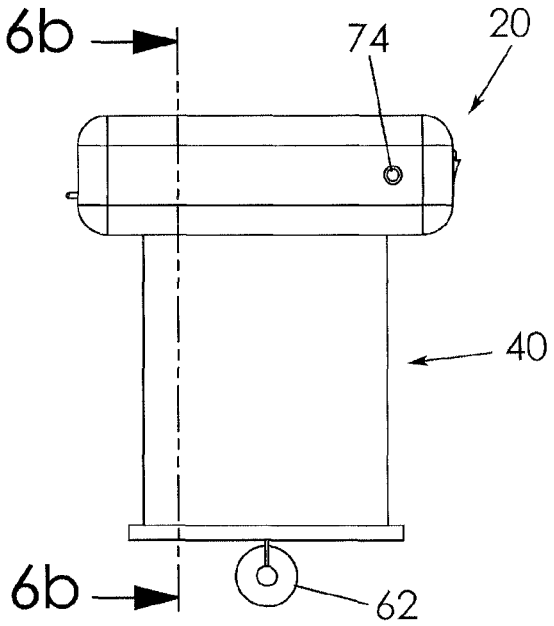
FIG. 6*a* is a top view of the apparatus as in FIG. 1.
Figure 6B:
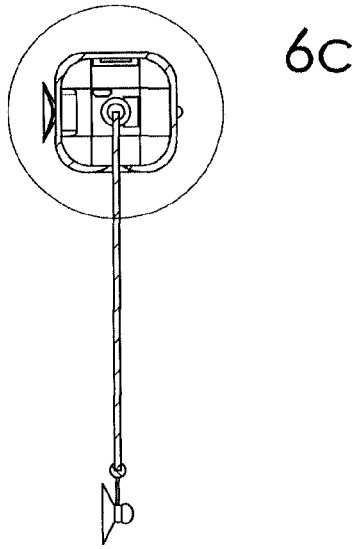
FIG. 6*b* is a sectional view taken along line 6*b*-6*b* of FIG. 6*a;*
Figure 6C:
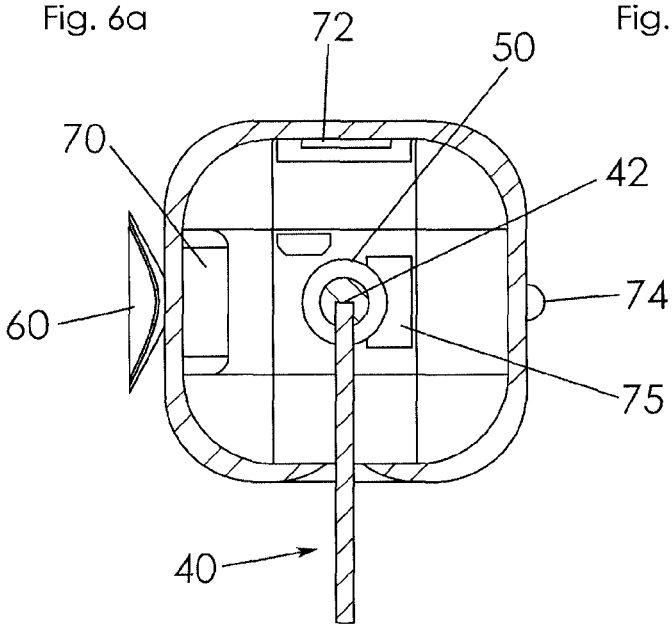
FIG. 6*c* an isolated view on an enlarged scale taken from FIG. 6*b;*
Figure 7A:
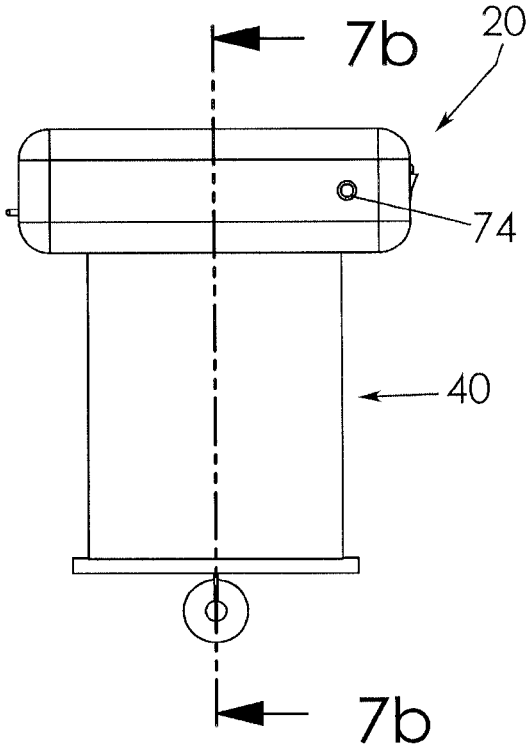
FIG. 7*a* is another top view of the apparatus as in FIG. 3*b;*
Figure 7B:
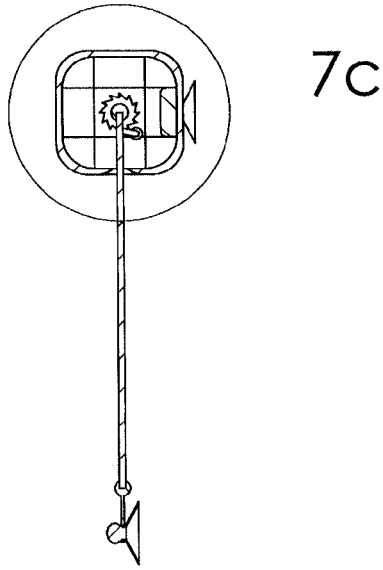
FIG. 7*b* is a sectional view taken along line 7*b*-7*b* of FIG. 7*a;*
Figure 7C:
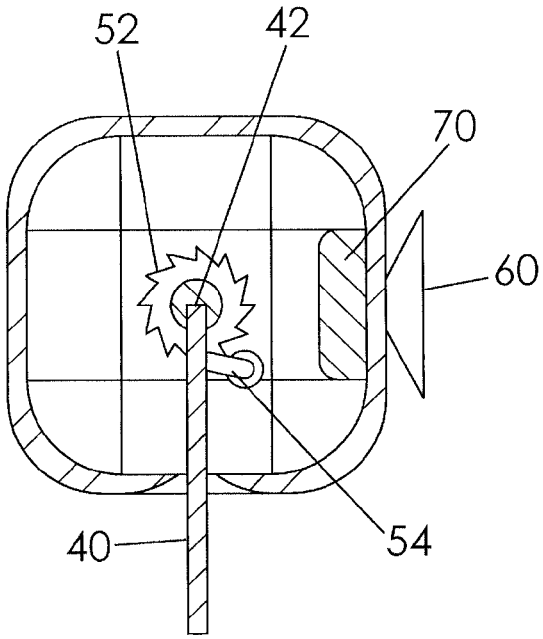
FIG. 7*c* is an isolated view on an enlarged scale taken from a portion of FIG. 7*b*.

A roller 50, such as a dowel rod, may be situated in the interior area and mounted to rotate therein (FIG. 6*c*). The first end 42 of the reflective panel 40 may be coupled to the roller 50 so that the reflective panel 40 is rolled up and received onto the roller 50 at the retracted configuration, the reflective panel 40 being constructed of a flexible material. The apparatus 10 may also include a ratchet gear 52 and pawl 54 combination in the interior area that is operatively coupled to the roller 50 such that the reflective panel 40 may be held at a selected configuration. More particularly, the ratchet gear 52 is rotated by the roller 50 when the reflective panel 40 is moved toward the extended configuration. The pawl 54 lodges in respective teeth of the ratchet gear 52 so as to prevent retraction of the reflective panel 40 about the roller 50 until the pawl is released. The pawl 54 is coupled to a retraction button 56 situated on a respective wall of the housing 20, such as a side wall. When the actuation button 56 is engaged, the pawl 54 is moved out of engagement with the ratchet gear 52 so that the reflective panel 40 may be moved to the retracted configuration. It is understood that the ratchet gear 52 or roller 50 may be coupled to a spring (not shown) that normally biases the roller 50 toward the retracted configuration.

The plurality of suction cups may include at least one housing suction cup 60. The housing suction cups 60 may be attached to the bottom wall 32 of the housing 20 (FIG. 2) and are configured to selectively couple the housing to a shower wall. Similarly, the plurality of suction cups may include a reflective panel suction cup 62 that is operatively connected to the free end 44 of the reflective panel 40 and may be employed to selectively couple the reflective panel 40 to a shower wall when the panel is at the extended configuration.

The heating member 70 may be positioned in the interior area of the housing 20. A battery 75 may also be situated in the housing interior area and is electrically connected to the heating member 70. The heating member 70 may be configured to heat the interior area when energized by the battery 75. Accordingly, the reflective panel 40 may be heated when the reflective panel 40 is at the retracted configuration and the battery 75 is activated to energize the heating member 70 to produce heat. The heating member 70 may be a gel pack that is activated to produce heat when energized by the battery. In another embodiment, the heating member 70 may be an electric heating element.

A power actuation switch 76 may be situated on a respective wall of the housing 20 and be electrically connected to the battery 75. When the power actuation switch 76 is operated, the battery 75 will energize the heating member 70 to produce heat in the interior area of the housing 20. The battery 75 may be rechargeable. Accordingly, a charging port 78 may be positioned on a respective wall of the housing 20 and be electrically connected to the battery 75 so that the battery 75 is charged when the charging port 78 is electrically connected to an electricity source. In some embodiments, a processor 72 may be situated in the interior area of the housing 20 and electrically connected to the battery 75, the heating member 70, and the actuation switch 76. The processor 72 may include programming for controlling the degree or timing of the heat member 70.

A light 74 may be situated on a wall of the housing 20 and be electrically connected to the battery 75 and to the power actuation switch 76. Preferably, the light 74 is a light emitting diode and is configured to be illuminated when the switch 76 has been actuated.

In use, the portable anti-condensation minor apparatus 10 may be packed in luggage or stored away when the reflection panel 40 is in the retracted configuration. When use is desired, such as to view one's face while shaving in the shower, the housing 20 may be mounted in a shower using the housing suction cup(s) 60. The power actuation switch 76 may be activated so that the battery 75 energizes the heating member 70 to heat the interior area and, as a result, the reflection panel 40. The reflection panel 40 may then be extended from the interior area through the slot 23. Preferably, the ratchet and pawl combination will hold the reflection panel 40 in the extended configuration until released by actuating the release switch 76. However, the reflection panel suction cup 62 may also be applied to the shower wall. When use of the apparatus 10 is no longer needed or desired, the reflection panel 40 may be released to return to the retracted configuration, the housing 20 may be detached from the shower wall and stored away.

It is understood that while certain forms of this invention have been illustrated and described, it is not limited thereto except insofar as such limitations are included in the following claims and allowable functional equivalents thereof.

The invention claimed is:

1. A portable anti-condensation mirror apparatus for use in a shower, comprising:

a housing having a plurality of walls defining an interior area, said plurality of walls including a front wall defining a slot that communicates said interior area with an area outside of said housing;

a reflection panel having a first end operatively coupled to said housing and an opposed free end, said reflection panel being movable between a retracted configuration substantially inside said interior area and an extended configuration extending through said slot and substantially outside said interior area;

at least one housing suction cup mounted to a respective wall of said housing, said housing suction cup configured to couple said housing to a wall of the shower;

a battery positioned in said interior area; and a heating member positioned in said interior area and electrically connected to said battery, said heating member configured to generate heat in said interior area when energized by said battery.

2. The apparatus as in claim 1, further comprising:

a roller positioned in said interior area, said first end of said reflection panel being coupled to said roller and configured to receive said reflection panel thereabout at said retracted configuration;

a ratchet and pawl combination operatively coupled to said roller and configured to hold said reflection panel at said extended configuration until released;

a retraction button positioned on a respective housing wall that is operatively coupled to said ratchet and pawl combination, said retraction button configured to release said reflection panel to move to said retracted configuration.

3. The apparatus as in claim 2, further comprising a spring operatively coupled to said roller that is configured to normally bias said reflection panel toward said retracted configuration when said ratchet and pawl combination is released.

4. The apparatus as in claim 2, wherein:

said reflection panel includes a front surface constructed of a reflective material; and said reflection panel is constructed of a flexible material that is stored about said roller at said retracted configuration.

5. The apparatus as in claim 2, wherein said reflection panel includes a handle at said free end configured to enhance a user in moving said reflection panel from said retracted configuration to said extended configuration.

6. The apparatus as in claim 1, further comprising a reflection panel suction cup coupled to said free end of said reflection panel, such that said reflection panel is selectively secured to the shower wall when the reflection panel is at said extended configuration.

7. The apparatus as in claim 1, wherein:

said battery is rechargeable; and said apparatus further comprises a charging port positioned on a respective housing wall and electrically connected to said battery, whereby said battery is charged when said charging port is electrically connected to an electricity source.

8. The apparatus as in claim 1, further comprising a power actuation switch situated on a respective housing wall and electrically connected to said battery, said power actuation switch being configured to actuate said battery to energize said heating member.

9. The apparatus as in claim 8, further comprising a light positioned on a respective wall of said housing, said light being electrically connected to said battery and to said power actuation switch, said light being configured to illuminate when said power actuation switch is activated.

10. The apparatus as in claim 9, wherein said light is a light emitting diode.

11. The apparatus as in claim 1, wherein said heating member is a heatable gel pack configured to emit heat in said housing interior area when energized.

12. The apparatus as in claim 1, further comprising a processor positioned in said interior area and electrically connected to said battery, said heating member, and said actuation switch.

13. The apparatus as in claim 1, wherein said battery is rechargeable.

* * * * *